United States Patent [19]

Pite et al.

[11] 3,974,352

[45] Aug. 10, 1976

[54] SWITCH ASSEMBLY MODULE WITH INSERTABLE ACTUATORS AND SWITCHES

[75] Inventors: Irving Pitel, Edison; Richard S. Silverman, Springfield; Richard J. Mueller, Mountain Lakes, all of N.J.

[73] Assignee: Rowe International Inc., Whippany, N.J.

[22] Filed: Jan. 15, 1975

[21] Appl. No.: 541,285

Related U.S. Application Data

[62] Division of Ser. No. 454,118, March 25, 1974.

[52] U.S. Cl. ..... 200/293; 200/295; 200/296; 200/307

[51] Int. Cl.[2] ..... H01H 13/04

[58] Field of Search ..... 200/5 R, 159 R, 293, 200/294, 295, 307, 308, 309, 340, 296, 330, 332, 5 A

[56] References Cited

UNITED STATES PATENTS

| | | | |
|---|---|---|---|
| 2,853,585 | 9/1958 | Danziger et al. | 200/340 |
| 3,182,163 | 5/1965 | Baumer | 200/307 |
| 3,586,806 | 6/1971 | Swisher | 200/294 X |
| 3,619,475 | 11/1971 | Bailey | 200/307 X |
| 3,663,780 | 5/1972 | Golbeck | 200/159 R X |
| 3,749,873 | 7/1973 | Harper et al. | 200/293 |
| 3,868,486 | 2/1975 | Nakaya | 200/340 X |

*Primary Examiner*—James R. Scott
*Attorney, Agent, or Firm*—Shenier & O'Connor

[57] ABSTRACT

A manually disassemblable push-button and switch unit assembly for a merchandising machine in which an elongated frame is formed with a plurality of spaced recesses open at the top and at the side of the frame and with a plurality of openings extending through the frame from the top to the bottom and disposed between the respective recesses to permit respective switch units to be inserted into the recesses through the side openings thereof with their actuating elements accessible through the top openings of the recess and with the switch units held in position by laterally extending spring fingers on the frame. Resilient fingers on a push-button extend through the frame openings at the sides of the recess so as to mount the push-buttons over the top openings of the recesses and for limited movement toward and away from the switch units to operate the actuating elements thereof.

7 Claims, 4 Drawing Figures

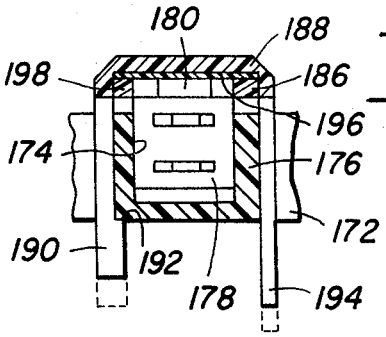
Fig 3
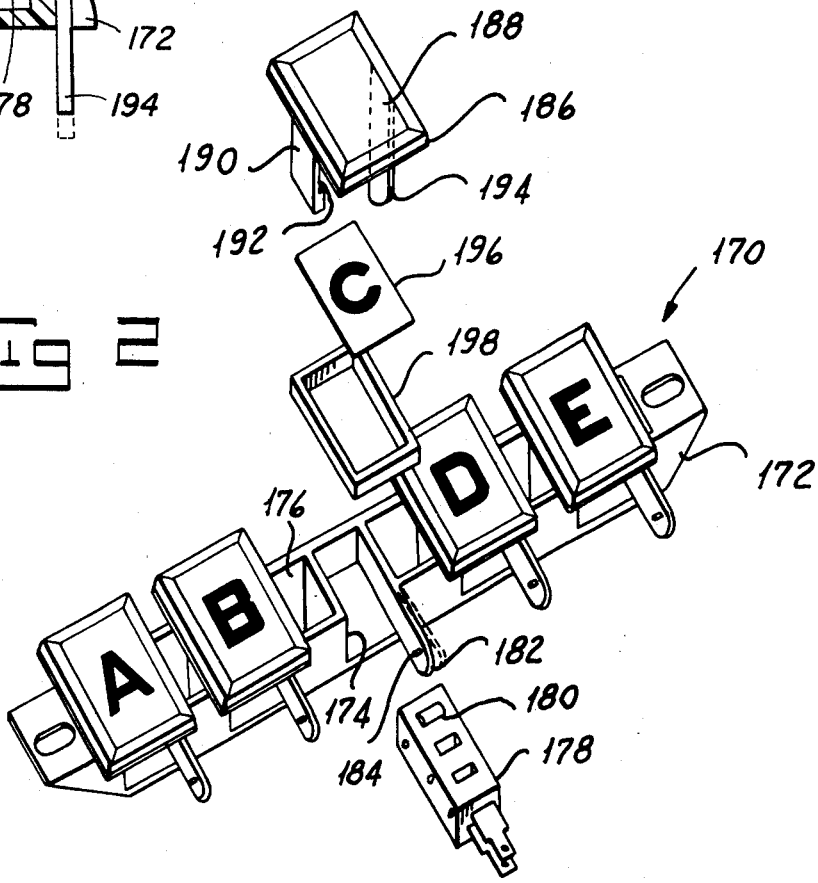
Fig 2
Fig 4
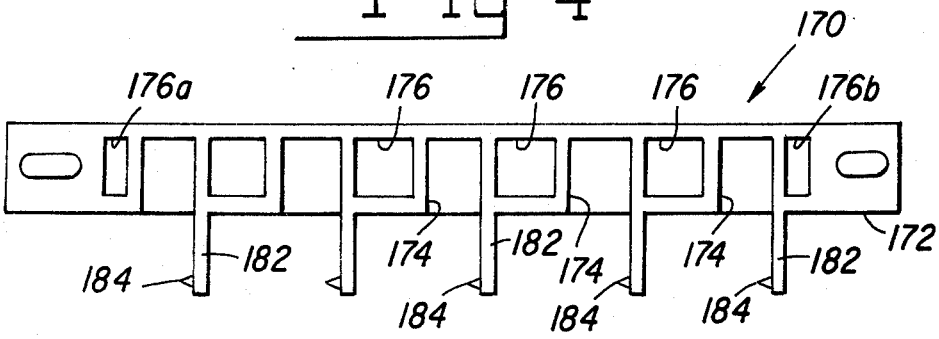

SWITCH ASSEMBLY MODULE WITH INSERTABLE ACTUATORS AND SWITCHES

This is a division of application Ser. No. 454,188 filed Mar. 25, 1974.

BACKGROUND OF THE INVENTION

Multiple choice merchandising machines of the type known in the prior art generally are provided with arrays of push-buttons which are accessible at the front of the machine and which can selectively be actuated to choose one of the variety of articles dispensed by the machine. Various forms of push-button switches have been employed. The push-button and switch assemblies of the prior art, however, incorporate a number of defects. Most of them are not readily assemblable. they cannot readily be disassembled without the use of tools for replacement of the switch element, for example. They do not readily lend themselves to a change of the indicia which associates the assembly with one of the merchandise delivery units of the machine.

We have invented a manually disassemblable push-button switch assembly for a merchandising machine which overcomes the defects of merchandising machine push-button switch assemblies of the prior art. The push-button of our assembly may readily be assembled in cooperative relationship with its associated switch without the use of tools. Once it has been assembled our push-button may individually be removed from the assembly to facilitate changing of the indicia carried thereby. Moreover, the switch of our assembly may readily manually be disassembled from the unit to permit replacement or repair thereof. Our push-button and switch unit is simple in construction.

SUMMARY OF THE INVENTION

One object of our invention is to provide a push-button and switch unit for a merchandising machine which overcomes the defects of push-button and switch assemblies of the prior art.

A further object of our invention is to provide a push-button and switch unit for a merchandising machine which unit can be assembled without the use of tools.

Another object of our invention is to provide a push-button and switch unit for a merchandising machine in which the push-button can manually be disassembled from the unit without disturbing the switch.

Still another object of our invention is to provide a push-button and switch unit for a merchandising machine in which the switch can be removed from the unit manually without disturbing the push-button.

Yet another object of our invention is to provide a push-button and switch unit for a merchandising machine which unit is simple in construction.

Other and further objects of our invention will appear from the following description.

In general our invention contemplates the provision of a push-button and switch unit for a merchandising machine in which an elongated frame forming member having a top, a bottom, front and a back is provided with a first plurality of switch-receiving recesses opening to the front and top of the member for receiving switches which are releasably held in the recesses with the actuating elements up by means of spring fingers extending from the bottom of the frame adjacent to each of the switch-receiving recesses and provided with detents adapted to snap into engagement with recesses in the switch bodies. Openings extending through the frame from top to bottom at the sides of each of the switch-receiving recesses are adapted to receive arms extending downwardly from a push-button slidably to mount the push-button on the frame. One arm is provided with a stop adapted to engage the back of the frame to limit movement of the button under the action of the spring loaded actuating element of the switch body.

BRIEF DESCRIPTION OF THE DRAWINGS

In the accompanying drawings which form part of the instant specification and which are to be read in conjunction therewith and in which like reference numerals are used to indicate like parts in the various views:

FIG. 2 is an exploded perspective view of our manually disassemblable push-button switch assembly for a merchandising machine.

FIG. 3 is a fragmentary sectional view of our manually disassemblable push-button switch assembly with a switch and push-button in assembled condition.

FIG. 4 is a top plan of the supporting frame of our manually disassemblable push-button switch assembly with parts removed.

DESCRIPTION OF THE PREFERRED EMBODIMENT

Figure 1:
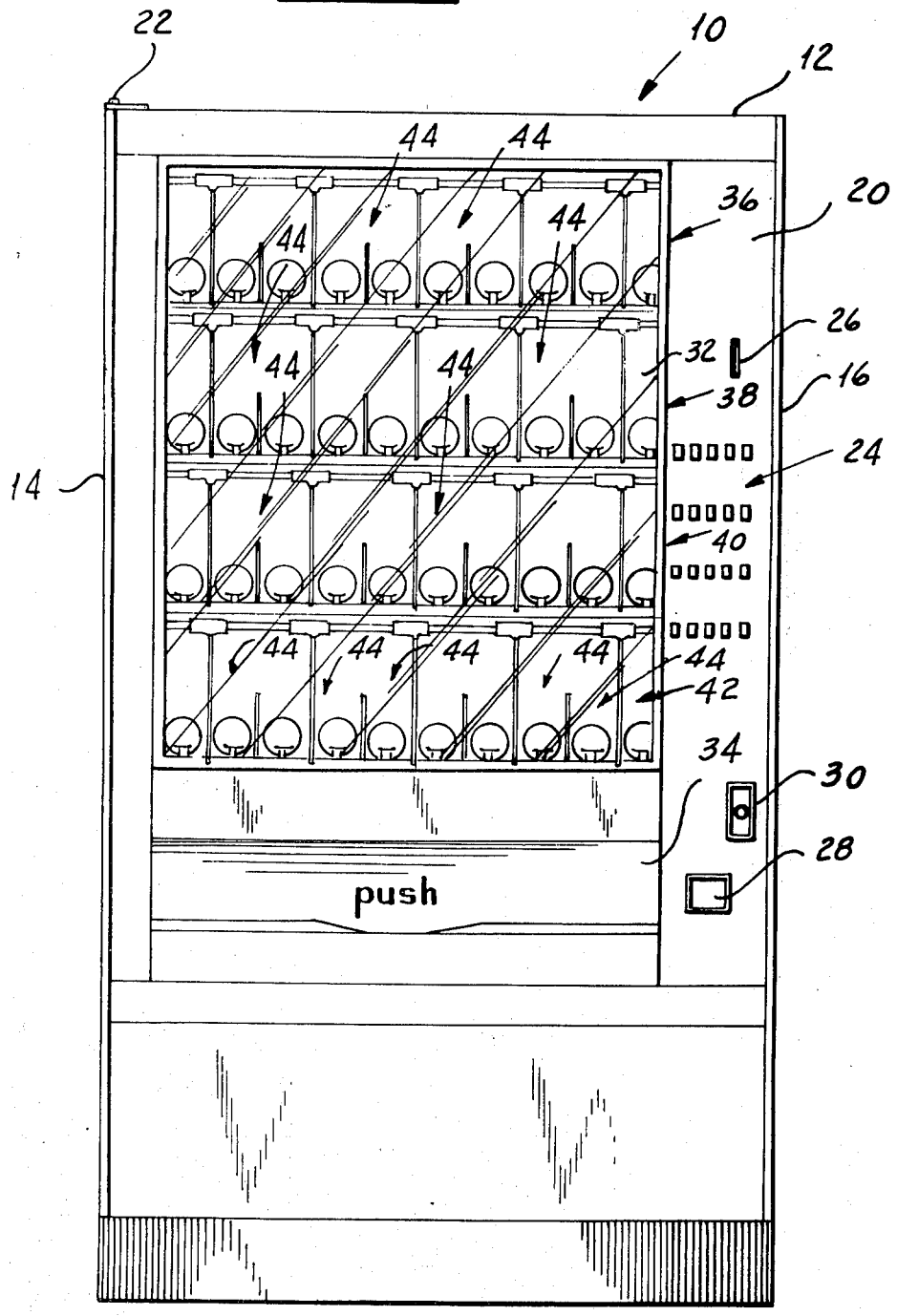
FIG. 1 is a front elevation of a merchandising machine provided with our manually disassemblable push-button switch assembly.

Referring now to FIGS. 1 to 5 of the drawings a merchandising machine, indicated generally by the reference character 10, which may be provided with our manually disassemblable push-button switch assembly, includes a cabinet 12 having sides 14 and 16 and a back 18. The open front of the cabinet 12 is adapted to be closed by a door 20 carried by a hinge 22 on the cabinet. Door 20 supports an array 24 of push buttons, a coin slot forming member 26, a coin return tray 28 and a lock 30. A window 32 in the door 20 permits the customer to view articles to be dispensed. Door 20 also supports a delivery box assembly 34 through which a dispensed article is accessible to the customer.

While we may provide our machine 10 with any practical number of delivery levels, in the particular embodiment illustrated in the drawings we provide four levels indicated generally respectively by reference characters 36, 38, 40 and 42. Each of the levels 36, 38, 40 and 42 is made up of a plurality of delivery units indicated generally respectively by reference characters 44. Each unit 44 is of the type which is especially adapted to dispense articles such as bagged snacks or the like.

Referring to FIGS. 2 to 4, the push button array 24 includes a plurality of mounting strips 172 secured to the inside of door 20 behind a row of push button openings. Each strip 172 is integrally formed with a plurality of rearwardly opening recesses 174 and intermediate vertical openings 176. Each selector switch assembly 178 has an activating element 180. Each assembly 178 is adapted to be slid into a recess 174 past a boss 184 carried by an integrally resilient arm 182 until the boss drops in a recess in the switch housing releasably to hold the assembly in position on strip 172.

Each push button 186 is formed with a window 188 and with a pair of resilient fingers 190 and 194. Fingers 190 are formed with grooves 192. An indicia bearing sheet 196 is adapted to be held in position by a frame 198. It may carry a letter to facilitate association of the button with the corresponding unit 44 by means of the selection indicator on support 98.

After the assemblies 178 have been positioned in the recesses 174 the assembly of a push button 186, a sheet 196, and a frame 198 is moved downwardly so that leg 190 extends downwardly through one opening 176 until the lower edge of notch 192 passes through the bottom of that opening and the other leg 194 extends downwardly through an adjacent opening 176. Actuating element 180 of the corresponding switch biases the assembly to an upper limit position from which it can be moved to operate member 180.

Referring to FIG. 3, it will be seen that with a switch 178 and a push-button 188 assembled on the frame 170 the actuating element 180 engages the underside of the indicia bearing sheet 196 to urge the push-button 188 to a position at which the lower edge of groove 192 engages the underside of the strip 172 adjacent to an opening 176 as illustrated in full lines in FIG. 3. When the push-button is pressed to move it to the broken line position shown in FIG. 3, element 180 is depressed to operate the switch.

It will be appreciated that each strip 172 is provided with the extreme outboard openings 176*a* and 176*b* which are somewhat narrower than are the intermediate openings 176 since the extreme outboard openings need accommodate only one of the fingers 190 or 194.

It will be seen that we have accomplished the objects of our invention. We have provided a push-button and switch assembly which overcomes the defects of push-button and switch assemblies employed in merchandising machine of the prior art. Our push-button and switch unit is readily manually assembled. The push-button may be manually removed after assembly without disturbing the switch to facilitate changing of the indicia associated therewith. The switch of our assembly can be manually disassembled from the unit without disturbing the push-button to permit repair or replacement of the switch. Our unit is relatively simple in construction.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. In a merchandising machine, a manually disassemblable push-button and switch unit assembly including a frame formed with a recess providing a side opening and a top opening, a switch unit having an element accessible externally of said unit for operating said switch unit, said switch unit adapted to be assembled in said frame recess through said side opening with said element accessible through said top opening, first manually operable interengageable means on said frame and on said switch unit for releasably retaining said switch unit in said recess, a push-button, second manually operable interengageable means on said frame and on said push-button for releasably mounting said push-button on said frame over said top opening in engagement with said actuating element and for limited movement toward and away from said switch unit to actuate said actuating element.

2. In a merchandising machine, a manually disassemblable push-button and switch assembly including an elongated frame formed with a plurality of recesses spaced along the length thereof, each of said recesses providing a side opening in said frame and a top opening in said frame, a plurality of individual switch units each having an element accessible externally of the unit for operating the switch unit, each of said switch units adapted to be assembled in one of said frame recesses through its side opening with the actuating element of the switch unit accessible through the corresponding top opening, first respective manually operable interengageable means on said frame and on said switch units for releasably retaining said switch units in said recesses, a plurality of push-buttons, respective second manually operable interengageable means on said frame and on said push-buttons for releasably mounting said push-buttons on said frame over the respective top openings in engagement with said actuating elements and for limited movement toward and away from said switch units to actuate said elements.

3. An assembly as in claim 2 in which said first interengageable means comprise respective spring fingers on said frame extending outwardly therefrom adjacent to said side openings and interengageable elements on said spring fingers and on said switch units.

4. An assembly as in claim 3 in which said interengageable elements comprise detents on said fingers and recesses on said switch units.

5. An assembly as in claim 2 including respective intermediate openings in said frame between said recesses, each of said intermediate openings extending through said frame from top to bottom, and in which said second interengageable means comprise resilient fingers on said push-buttons, said fingers adapted to extend through said intermediate openings and lugs on said fingers for engaging the bottom of said frame to limit movement of said push-buttons away from said switch units.

6. An assembly as in claim 2 including respective intermediate openings in said frame between said recesses, said intermediate openings extending through said frame from top to bottom thereof, and in which said second interengageable means comprise respective pairs of spring fingers on said push-buttons, the spring fingers of a pair extending through respective intermediate openings at the sides of the recess with which a push-button is associated and a lug on one finger of each pair for engaging the underside of the frame adjacent to the corresponding intermediate opening to limit movement of the push-button away from its associated switch.

7. As assembly as in claim 6 in which said first interengageable means comprise respective laterally extending spring fingers on said frame adjacent said side openings and interengageable elements on said lateral spring fingers and on said switch units.

* * * * *